US005727601A

United States Patent [19]

Krumm

[11] Patent Number: 5,727,601

[45] Date of Patent: Mar. 17, 1998

[54] METHOD FOR COOLING A LOOM GRIPPER DRIVE AND COOLING DEVICE FOR PERFORMING THE METHOD

[75] Inventor: Valentin Krumm, Hergensweiler, Germany

[73] Assignee: Lindauer Dornier Gesellschaft mbH, Lindau, Germany

[21] Appl. No.: 723,533

[22] Filed: Sep. 30, 1996

[30] Foreign Application Priority Data

Oct. 14, 1995 [DE] Germany ..... 195 38 287.0

[51] Int. Cl.[6] ..... D03J 1/00

[52] U.S. Cl. ..... 139/449; 139/1 R

[58] Field of Search ..... 139/449, 1 R

[56] References Cited

U.S. PATENT DOCUMENTS

| | | | |
|---|---|---|---|
| 4,046,224 | 9/1977 | Smutny | 139/449 |
| 4,117,869 | 10/1978 | Rushman | 139/1 R |
| 4,520,848 | 6/1985 | Lucian et al. | 139/1 R |
| 5,097,873 | 3/1992 | Muller et al. | 139/449 |
| 5,601,121 | 2/1997 | Bonacina | 139/449 |

FOREIGN PATENT DOCUMENTS

| | | | |
|---|---|---|---|
| 0565945 | 10/1993 | European Pat. Off. | 139/1 R |
| 406192948 | 7/1994 | Japan | 139/1 R |
| WO 92/15738 | 9/1992 | WIPO . | |

OTHER PUBLICATIONS

"textil praxis international", Mar. 1991, pp. 224 to 234 untranslated.

*Primary Examiner*—Andy Falik
*Attorney, Agent, or Firm*—W. G. Fasse; W. F. Fasse

[57] ABSTRACT

A gripper drive for a rapier loom is cooled by enclosing the gripper drive with a cooling medium flow guide housing and passing a cooling medium, such as conditioned air, through said guide housing so that a cooling medium flow must pass said gripper drive in heat exchange contact therewith. The cooling medium is either a suction medium or a pressurized medium and passes through a flow port and slots or openings in the flow guide housing.

22 Claims, 1 Drawing Sheet

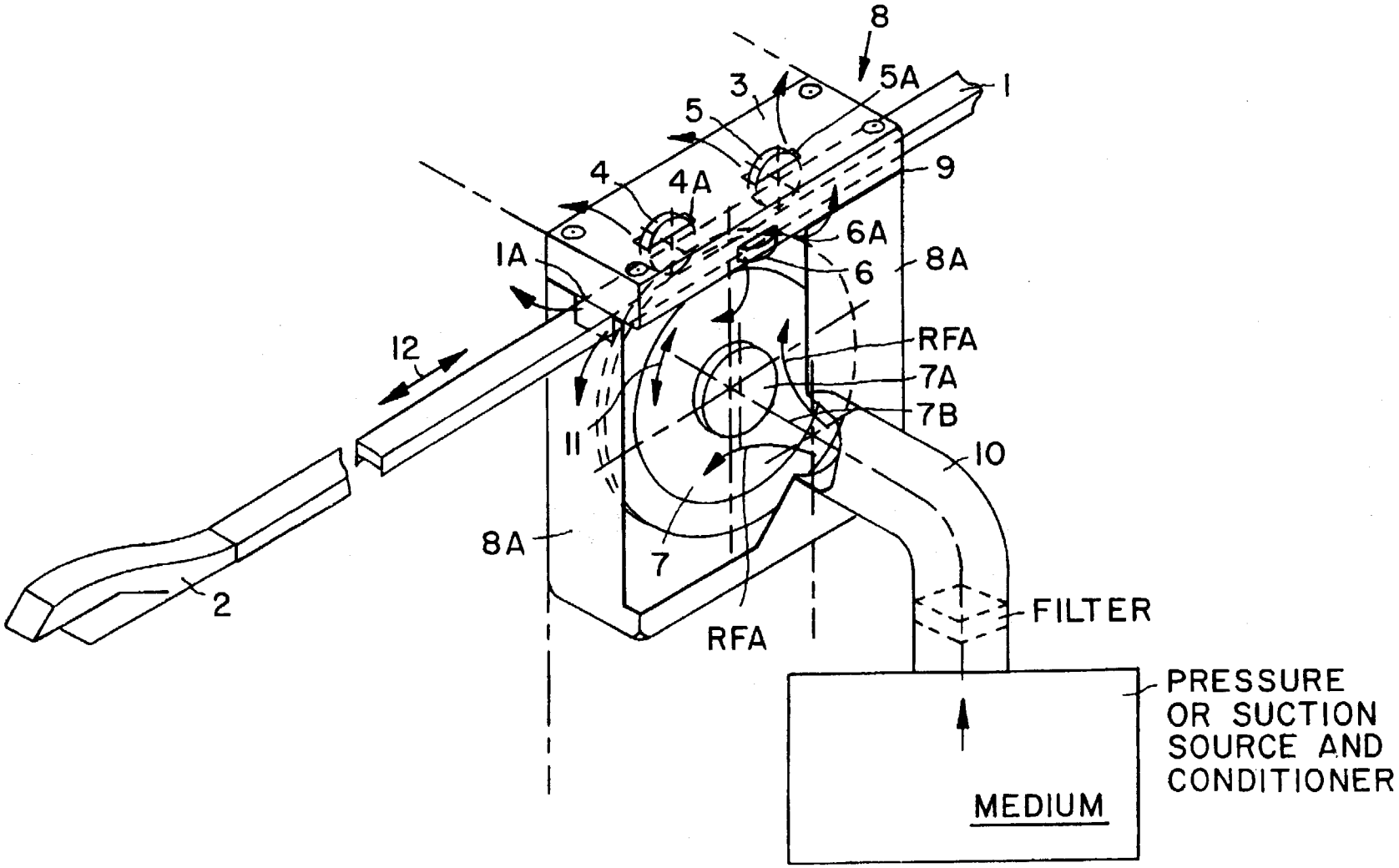
PRESSURE OR SUCTION SOURCE AND CONDITIONER
FILTER
MEDIUM
1
2
3
4
4A
5
5A
6
6A
7
7A
7B
8
8A
9
10
11
12
1A
RFA
RFA

METHOD FOR COOLING A LOOM GRIPPER DRIVE AND COOLING DEVICE FOR PERFORMING THE METHOD

FIELD OF THE INVENTION

The invention relates to a method and apparatus for cooling a gripper drive in a rapier loom.

BACKGROUND INFORMATION

Various constructions of weft insertion components for looms are known in the art. One type relates to gripper or rapier looms which use elongated, stiff rods or rapiers carrying a gripper head at the free end of the rapier for seizing and transporting weft threads through the loom shed. Known rapiers for carrying the gripper heads are relatively rigid, yet simultaneously of lightweight construction. Such rapiers are made of fiber composite or fiber reinforced materials and have a U-shaped cross-sectional configuration with a toothed rack integrated into the rapier. At least one drive wheel or rather drive pinion meshes with the toothed rack whereby the rotational direction of the pinion is repeatedly reversed for the insertion and withdrawal of the rapier into and from the loom shed.

Other weft insertion or carrier components comprise flexible tapes carrying a gripper head at one of its ends while the other end of the tape is connected to a drive wheel. The tapes must have a certain stiffness to assure the proper transport of the weft yet must be sufficiently flexible to be repeatedly wound onto and off the drive wheel which is driven to rapidly and repeatedly reverse its rotational drive direction.

All of the above weft insertion components and respective guides are subject to certain limitations in their weft insertion capacity (shots per unit of time) particularly due to the friction heat that is being generated by the drive and guide components. This friction and respective heat generation leads to a rapid wear and tear especially of those insertion components that participate in the drive and guide motions. This is particularly applicable where the insertion components and the drive components are made of synthetic materials.

Moreover, the operational life of the drive and guide components is adversely affected by fly dust generated during the weaving. Such fly dust has a tendency to enter into the area of the drive and guide components where it contributes to an increased wear and tear.

OBJECTS OF THE INVENTION

In view of the above it is the aim of the invention to achieve the following objects singly or in combination:

- to remove heat, especially friction heat generated in the area of the weft insertion drive and guide components;
- to positively cool the weft insertion drive and guide components by a guided flow of cooling fluid;
- to effectively keep fly dust away from these components; and
- to use either pressurized air or suction air for exposing the weft insertion drive and guide components to a flow of cooling medium at least during operation.

SUMMARY OF THE INVENTION

According to the present method a heat removing medium such as pressurized air or suction air is caused to flow through a housing that guides the cooling medium flow through the housing into rinsing or heat exchange contact with the weft insertion drive and guide components.

In a preferred embodiment the drive pinion that repeatedly reverses the weft insertion and return motion direction and preferably also any rapier or tape guide components are enclosed by the cooling medium guide housing which is connected to a source of cooling medium. This source is either a compressor for blowing cooling medium such as preferably air-conditioned and/or filtered air through the cooling medium guide housing, or the source is a suction source for sucking the cooling medium through the guide housing.

If the cooling medium is blown under pressure into the guide housing or sucked through the housing the cooling medium flows in heat exchange contact with the gripper or tape drive and passes out of the guide housing through slots or gaps or openings provided in the housing walls between the rapier or tape and the respective housing wall. Similarly, the same flow with the same effect is produced when the cooling medium is sucked through the guide housing to which a suction source is connected. The cooling is preferably also applied to any guide rollers of the weft insertion components, whereby similar slots are provided between the guide rollers and respective housing wall portions. Additional slots or openings may be provided in the housing walls or between housing wall portions or sections.

The construction of the guide housing is preferably such that the pressure port or the suction port of a compressor or fan can be connected to the same housing port or flow duct connected to the guide housing. The generation of a reduced pressure in the cooling medium guide housing is preferred for looms weaving so-called technical fabrics made of monofilaments used for both the weft and warp threads. In those instances where reduced pressure is generated in the guide housing, atmospheric air may be used as the cooling medium entering through the above mentioned openings, gaps and slots.

In both instances described above the cooling medium noticeably reduces the operating temperature of the cooled loom components. Additionally, these components are kept free of fly dust which prolongs the operational life of these components while simultaneously permitting increasing the weft insertion capacity by about 10% compared to a loom of otherwise identical construction, but without the present cooling system. These advantageous effects are achieved by the use of pressurized or suction cooling medium. In both instances fly dust is prevented from settling on the components and effectively removed by the flow of cooling medium.

Further, in both instances the resistance of the cooled components against wear and tear is substantially increased. This applies particularly to the moving loom components, namely the weft insertion components, the drive pinion, and the guide rollers. Where pressurized cooling medium is used the entry of fly dust into the guide housing is altogether prevented by the cooling medium flow out of the guide housing, where it is assured that fly dust particles contaminated with lubricants, e.g. oil or grease, are not generated and hence cannot contaminate the fabric that is being woven on the loom.

BRIEF DESCRIPTION OF THE DRAWING

In order that the invention may be clearly understood, it will now be described, by way of example, with reference to the accompanying single FIGURE showing a perspective view of the present cooling device of a loom gripper drive.

DETAILED DESCRIPTION OF PREFERRED EXAMPLE EMBODIMENTS AND OF THE BEST MODE OF THE INVENTION

The example is illustrated with reference to a gripper rod or rapier 1 for the weft insertion. However, the invention is equally applicable to tape drives for the weft insertion. In both instances a gripper head 2 is carried at the free end of the respective carrier. The gripper head construction is not critical for the invention and is hence not described.

The gripper head carrier in the form of the rapier 1 has a U-shaped sectional profile into which a toothed rack is integrated for meshing with at least one drive pinion 7 operatively mounted in a cooling medium guide housing 8 on a drive shaft 7A preferably centrally positioned with its rotation axis 7B in the guide housing 8. The pinion is driven clockwise and counterclockwise as indicated by the double arrow 11. The respective back and forth movement of the rapier 1 is indicated by the double arrow 12.

Rollers 4, 5, 6 are rotatably mounted in the guide housing 8 for guiding the back and forth movement of the rapier 1. The rollers 4 and 5 restrain the rapier in the vertical direction to permit the rapier 1 to move horizontally back and forth. At least one roller 6 restrains the rapier 1 against lateral excursions. Preferably, the guide rollers 4, 5,6 are mounted in a separable housing cover 3.

The housing 8 encloses the drive pinion 7 and the area next to the meshing between the pinion 7 and the rapier 1 for guiding cooling medium into heat exchange contact with these areas and the pinion. Vertical housing walls 8A leave the housing 8 upwardly open and the respective opening is substantially closed by a cover 3 which also forms a support or mounting plate for the housing 8. The cover 3 and the vertical housing walls 8A form openings 1A for the back and forth movement of the rapier 1. These openings are so dimensioned that gaps remain for cooling medium to pass through in heat exchange contact with the rapier 1. At least one further gap or slot 9 is provided between the cover 3 and an upwardly facing edge of the vertical housing walls 8A to permit cooling medium flow through this gap or gaps 9. Further gaps 4A, 5A, 6A are provided in the cover 3 next to the guide rollers 4, 5, and 6. These further gaps make sure that cooling medium can flow in heat exchange contact past these guide rollers 4, 5, 6.

A cooling medium flow duct 10 is connected preferably centrally to the housing 8 so that cooling medium is caused to flow in heat exchange contact with the drive pinion 7. The flow duct 10 is connected to a vacuum source or to a pressure source and preferably also to a conditioning device such as an air-conditioner, humidifier, filter and the like. As the cooling medium flow passes through the housing 8, the cooling medium cools the drive pinion 7, the rapier 1, and the guide rollers 4, 5, 6. More specifically, the flow duct 10 in its preferred central position blows the cooling medium in an inflow direction substantially coinciding with the rotational axis 7B onto a surface of the pinion 7 so that the incoming cooling medium impinges centrally on the pinion surface which deflects the cooling medium to flow radially outwardly in outflow direction as shown by radial flow arrows RFA. By blowing the cooling medium first onto a radially extending surface of the gripper drive pinion 7, this surface deflects the cooling medium radially outwardly to assure an optional heat exchange contact with the drive pinion in and through said cooling medium flow guide housing.

If the cooling medium flow is a pressurized flow into the housing 8, the flow exits from the housing through the above described gaps, openings, etc. and thereby first cools all components in the housing 8 and then prevents fly dust from entering into the housing as indicated by the several arrows shown in the FIGURE.

The same cooling effect is achieved when suction air is passed through the housing 8. In this instance the flow prevents fly dust from settling.

Although the invention has been described with reference to specific example embodiments, it will be appreciated that it is intended to cover all modifications and equivalents within the scope of the appended claims.

What is claimed is:

1. A method for cooling a gripper drive pinion in a loom, said method comprising the following steps:

(a) constructing a cooling medium flow guide housing to fit around said gripper drive pinion, (b) enclosing said gripper drive pinion with said cooling medium flow guide housing, and (c) feeding a cooling medium through said cooling medium flow guide housing so that said cooling medium must first flow into heat exchange contact with at least one surface of said gripper drive pinion in and through said cooling medium flow guide housing.

2. The method of claim 1, further comprising pressurizing said cooling medium to provide a pressurized cooling medium prior to said feeding step.

3. The method of claim 1, comprising:

(a) pressurizing air as said cooling medium in a pressurized container, and (b) connecting said pressurized container to said cooling medium guide housing.

4. The method of claim 3, further comprising increasing the relative humidity of said pressurized air prior to feeding said pressurized air through said cooling medium guide housing.

5. The method of claim 3, further comprising air-conditioning said pressurized air prior to feeding said pressurized air through said cooling medium guide housing.

6. The method of claim 1, comprising performing said feeding step by connecting said cooling medium guide housing to a vacuum source and sucking said cooling medium through said cooling medium guide housing.

7. The method of claim 6, further comprising using air as said cooling medium and increasing the relative humidity of said air prior to sucking said air through said cooling medium guide housing.

8. The method of claim 6, further comprising using air as said cooling medium and air-conditioning said air prior to sucking said air through said cooling medium guide housing.

9. The method of claim 1, further comprising guiding said cooling medium with said cooling medium flow guide housing so as to surround said gripper drive with said cooling medium.

10. The method of claim 1, further comprising filtering said cooling medium prior to said feeding step.

11. The method of claim 1, further comprising blowing said cooling medium in an inflow direction onto said at least one surface of said gripper drive pinion and deflecting said cooling medium by said at least one surface of said gripper drive pinion in an outflow direction out of said cooling medium flow guide housing.

12. A device for cooling a gripper drive in a loom, wherein said gripper drive includes a gripper carrier with a toothed rack and a drive pinion meshing with said toothed rack for moving said toothed rack back and forth, said cooling device comprising a cooling medium guide housing having housing walls for enclosing said drive pinion, first and second openings in said housing walls positioned opposite each other for said gripper carrier to pass back and forth through said cooling medium guide housing, and a cooling medium flow port positioned for passing a cooling medium through said cooling medium guide housing in heat exchange contact with a surface of said gripper drive pinion.

13. The device of claim 12, wherein said first and second openings form a cooling medium flow gap between said rapier and a portion of said housing walls including said first and second openings.

14. The device of claim 12, further comprising rapier guide rollers rotatably mounted in said cooling medium guide housing in positions exposed to said cooling medium passing through said cooling medium guide housing.

15. The device of claim 14, further comprising third openings in said cooling medium guide housing, said rapier guide rollers being so positioned in said cooling medium guide housing that cooling medium flowing through said third openings must pass said rapier guide rollers.

16. The device of claim 15, wherein said rapier guide rollers comprise at least one first guide roller having a horizontal rotational axis and at least one second guide roller having a vertical rotational axis, and wherein said third openings form at least one upwardly facing cooling medium flow gap and at least one laterally facing cooling medium flow gap.

17. The device of claim 15, wherein said rapier guide rollers extend partly out of said cooling medium guide housing through said third openings.

18. The device of claim 17, wherein said third openings and said rapier guide rollers form cooling medium flow gaps.

19. The device of claim 12, wherein said housing walls comprise a mounting wall and further walls, and at least one cooling medium flow slot (9) between said mounting wall (3) and at least one of said further walls.

20. The device of claim 19, wherein said cooling medium flow slots positioned substantially horizontally.

21. The device of claim 12, further comprising at least one cooling medium treatment device connected to said cooling medium flow port.

22. The device of claim 11, wherein said drive pinion comprises a rotational axis (7B) and a pinion surface extending radially to said rotational axis, and wherein said cooling medium flow port has a central axis substantially coinciding with said rotational axis of said drive pinion so that said cooling medium exiting from said cooling medium flow port and entering into said cooling medium guide housing impinges centrally on said pinion surface to flow radially outwardly along said radially extending pinion surface.

* * * * *

UNITED STATES PATENT AND TRADEMARK OFFICE

CERTIFICATE OF CORRECTION

PATENT NO. : 5,727,601

DATED : Mar. 17, 1998

INVENTOR(S) : Krumm

It is certified that error appears in the above-identified patent and that said Letters Patent is hereby corrected as shown below:

Col. 3, line 59, after "in" insert --an--.
line 63, after "an" replace "optional" by --optimal--.

Col. 5, line 11, before "and" replace "rapier" by --gripper carrier--.

Col. 6, line 13, after "flow" replace "slots" by --slot is--;
line 17, after "of" replace "claim 11," by --claim 12--.

Signed and Sealed this

Twenty-sixth Day of May, 1998

*Attest:*

BRUCE LEHMAN

*Attesting Officer*

*Commissioner of Patents and Trademarks*